United States Patent [19]

Farrar et al.

[11] Patent Number: 4,820,174

[45] Date of Patent: Apr. 11, 1989

[54] MODULAR CONNECTOR ASSEMBLY AND FILTERED INSERT THEREFOR

[75] Inventors: John C. Farrar, Harrisburg; Reuben E. Ney, Mount Joy; James L. Schroeder, III, Palmyra; Patrick F. Yeager, Middletown, all of Pa.

[73] Assignee: AMP Incorporated, Harrisburg, Pa.

[21] Appl. No.: 893,800

[22] Filed: Aug. 6, 1986

[51] Int. Cl.[4] ..... H01R 4/66

[52] U.S. Cl. ..... 439/95; 439/620; 439/608

[58] Field of Search ..... 339/196, 248, 206, 241, 339/242, 143, 147, 136, 139 C, 217 S, 59, 14; 333/70, 79

[56] References Cited

U.S. PATENT DOCUMENTS

| | | | |
|---|---|---|---|
| Re. 29,258 | 6/1977 | Fritz | 333/70 S |
| 3,200,355 | 8/1965 | Dahlen | 333/79 |
| 3,275,953 | 9/1966 | Coda et al. | 333/79 |
| 3,275,954 | 9/1966 | Coda et al. | 333/79 |
| 3,491,330 | 1/1970 | Barnhart et al. | 339/184 |
| 3,535,676 | 10/1970 | Schultz, Sr. | 339/143 |
| 3,562,696 | 2/1971 | Barnhart et al. | 339/60 |
| 3,670,292 | 6/1972 | Tracy | 339/147 R |
| 3,854,107 | 12/1974 | Tuchto et al. | 339/59 M |
| 3,873,172 | 3/1975 | Paullus | 339/17 F |
| 3,930,210 | 12/1975 | Hollyday | 333/79 |

*Primary Examiner*—David Pirlot

*Attorney, Agent, or Firm*—Katherine A. Nelson

[57] ABSTRACT

Modular electrical connector assemblies and filtered connector inserts therefor. The assembly includes one or more filtered connector inserts releasably mounted within an outer conductive shell. A plurality of filtered contact assemblies are releasably retained within the insert. Each filtered contact assembly includes an electrical contact, a filter electrically coupled to the contact, and a first grounding means electrically coupled to said filter. The filtered contact assemblies are releasably and electrically coupled to the insert when the assemblies are releasably mounted to the insert, and to the outer shell when the insert is mounted within the shell. With the invention, a grounding path is automatically provided from the filter associated with each filtered contact assembly to the outer shell to dissipate filtered interference, while allowing individual removal and replacement of each filtered contact assembly from the insert, and removal and replacement of each insert from the shell. The filtered inserts have the same dimensions and contact placement as their corresponding unfiltered inserts, and are fully interchangeable therewith.

8 Claims, 6 Drawing Sheets

MODULAR CONNECTOR ASSEMBLY AND FILTERED INSERT THEREFOR

BACKGROUND OF THE INVENTION

The present invention relates generally to electrical connector assemblies and, more particularly, to modular electrical connector assemblies, to filtered connector inserts for such assemblies and to filtered contact assemblies for such inserts.

High-density, multiple-contact, electrical connectors are used in many applications. In aircraft, for example, such connectors are often used to interface wiring from various locations throughout the aircraft with processing circuitry located within a bulkhead of the aircraft.

For convenience and flexibility, it is known to manufacture such connectors in the form of modular assemblies in which one or more connector modules or inserts are supported within an outer shell. Both the outer shell and the inserts are manufactured in a variety of standard configurations; and to form a connector assembly suitable for a particular application, it is only necessary to select the appropriate shell and inserts and mount the inserts within the shell. The assembly as a whole can then be mounted to a bulkhead or other mounting surface for use.

For even greater flexibility, the inserts are removably mounted within the shell. Accordingly, if replacement of a particular insert is desired, it is a simple matter to remove the insert from the shell and mount a new insert in its place. It is not necessary to replace the assembly as a whole or to interfere with other inserts in the assembly.

There are many applications in which it is desirable to provide a connector insert with a filtering capability; for example, to suppress EMI or RFI interference or other undesired signals which may exist in circuits connected by the inserts. To retain the convenience and flexibility of the connector assemblies, however, it is desirable that the filtering capability be incorporated into the inserts in a manner that will permit full interchangeability between the filtered inserts and their unfiltered counterparts. In particular, any filtered insert should retain substantially the same dimensions as the corresponding unfiltered insert so that either can be mounted within the same aperture in a standard shell. Also, both the filtered and unfiltered versions of an insert should have the same contact placement so that either can be connected to appropriate mating connectors. In addition, any filtered insert should be capable of being mounted to a shell in a removable manner to retain the flexibility of the assembly.

Filtered, multiple-contact connnectors usually must be electrically coupled to external grounding structure to properly dissipate the filtered energy. In prior connectors, this was frequently accomplished by soldering or otherwise permanently electrically connecting a ground plate or other grounding structure in the insert to the filter element associated with each contact and to suitable external grounding structure. A permanent connection between the ground plate in the insert and external grounding structure is not suitable in the abovedescribed connector assemblies as it would prevent the inserts from being easily mounted to or removed from the shells. Other filtered connectors have utilized relatively complex spring mounts to couple the connector grounding plane to external ground. Spring mounts are relatively expensive and are also not conducive to quick mounting and removal of inserts from the shells of modular connector assemblies.

A permanent electrical connection between the individual filter elements associated with each contact and the grounding plate in the insert is also not desirable in the above-described connector assemblies. Specifically, during manufacture or use of the connector, one or a few of the contacts may become damaged or broken and require repair or replacement. If the filter elements are all soldered or otherwise permanently attached to the grounding plate, it will be necessary to replace the entire grounding plate and all the filtered contacts attached thereto. Since a connector insert may contain as many as 150 separate contacts, replacement of the entire grounding plate and its associated filtered contacts can be relatively costly.

SUMMARY OF THE INVENTION

In accordance with the present invention, an electrical connector assembly is provided which comprises an electrically conductive shell including at least one insert-receiving aperture; a filtered connector insert positioned within the insert-receiving aperture, said insert including a housing; at least one filtered contact assembly within the housing, each filtered contact assembly including an electrical contact and filter means electrically coupled to the contact; means for defining a grounding plane for electrically coupling the filter means to the shell for providing a grounding path from the filter means to the shell for dissipating filtered interference; means for releasably retaining each filtered contact assembly within the housing; and means for releasably mounting said insert within the shell.

According to a presently preferred embodiment, each filtered contact assembly comprises a soldered contact pin/filter sleeve subassembly which is soldered to and potted within an electrically conductive, tubular-shaped eyelet. The eyelet seals and protects the filter element encapsulated therein and also functions as a first portion of a grounding plane to dissipate interference filtered by the filter.

Each filtered contact assembly can be individually inserted into or removed from apertures in the connector insert without disassembly of the insert. First electrical coupling means is provided on ground plate incorporated within the insert housing (which serves as a second portion of the grounding plane) and/or on the conductive eyelet of each filtered contact assembly to automatically, releasably, and electrically couple the eyelet and the ground plate when the filtered contact assembly is inserted into the insert to complete a grounding path therebetween. In accordance with one embodiment of the invention, the first electrical coupling means comprises spring fingers extending into the apertures in the ground plate to contact the eyelet when the filtered contact assemblies are inserted into the apertures. According to an alternative embodiment, the first electrical coupling means comprises spring fingers extending from the eyelets and positioned to contact the ground plate upon insertion of the filtered contact assemblies into the apertures.

In accordance with a further aspect of the invention, retention means are provided to releasably retain each filtered contact assembly within the insert. In accordance with one embodiment of the invention, the retention means includes an annular rib within each aperture in the insert which is adapted to engage an annular groove in each filtered contact assembly when the assemblies are inserted into the insert. In accordance with an alternative embodiment of the invention, the retention means includes a retention spring on each filtered contact assembly positioned to engage an internal shoulder within each aperture when the filtered assemblies are correctly positioned within the insert.

In accordance with yet a further aspect of the invention, second electrical coupling means is provided to releasably electrically couple the ground plate with the insert to the shell within which the insert is mounted. According to a presently preferred embodiment, the second electrical coupling means includes a plurality of spring-like fingers integral with the ground plate which extend outwardly around the periphery of the insert. When the insert is mounted within an insert-receiving aperture in the connector shell, the fingers engage the walls of the connector shell to electrically couple the ground plate to the shell to dissipate filtered interference from the ground plate to external ground.

With the present invention, a modular connector assembly is provided in which a reliable grounding path is provided from the filters associated with each contact in a filtered connector insert, to the connector shell while permitting individual removal and replacement of any filtered contact from the insert and of each insert as a whole from the connector shell. With the invention, one or a few filtered contacts can be removed from the insert for repair or replacement, either during manufacture or in the field, without necessitating replacement of an entire ground plate and all the contacts mounted thereon. The convenience and flexibility of the modular connector assembly is thus retained in full while permitting the use of filtered connector inserts therein.

The filtered connector insert of the present invention preferably has the same dimensions and contact placement as its unfiltered counterpart, and is fully interchangeable therewith. This permits the filtered insert to be mounted at the same location within the same standard connector shell, and to be connected to the same mating connector as its corresponding unfiltered insert.

In accordance with the present invention, the filter means incorporated within each filtered contact assembly can comprise any of various types of filtering elements commonly used in the connector field including tubular capacitor filters and distributed element filters. According to one embodiment of the invention, the filter means can also comprise a lumped element pi filter in tubular shape which can be incorporated within the tubularshaped eyelet.

Further advantages and specific details of the invention will be set forth hereinafter in the following detailed description of presently preferred embodiments taken in conjunction with the drawings.

DETAILED DESCRIPTION OF THE PREFERRED EMBODIMENTS

Figure 1:
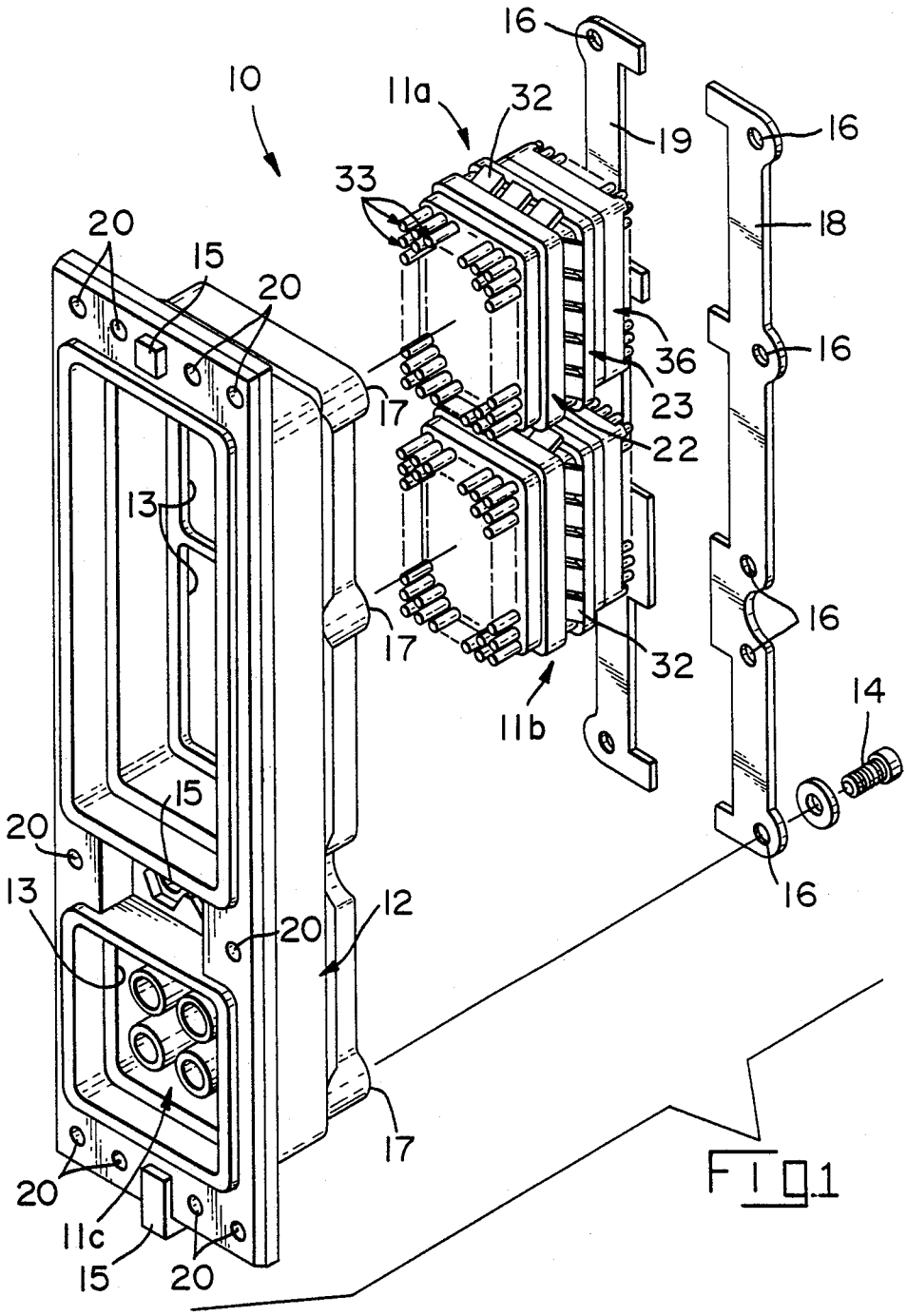
FIG. 1 is an exploded perspective view of a modular connector assembly according to a presently preferred embodiment of the invention.

FIG. 1 illustrates a connector assembly according to a presently preferred embodiment of the invention. The assembly is generally designated by reference numeral 10, and comprises a plurality of electrical connector inserts 11*a*, 11*b* and 11*c* supported within a metallic outer shell 12. As shown, shell 12 is configured to define a plurality of insert-receiving apertures 13; and inserts 11*a*–11*c* are adapted to be positioned within apertures 13 and retained therein by being sandwiched between shell 12 and a pair of rear retaining plates 18 and 19. A plurality of mounting screws 14 extend through aligned apertures 16 and 17 in rear retainer plates 18 and 19 and the shell, respectively, releasably retain the inserts in the shell.

For convenience and flexibility, connector assembly 10 is of modular construction. Both the outer shell 12 and the connector inserts 11*a*–11*c* are manufactured in a variety of configurations; and to construct an assembly suitable for a particular application, it is only necessary to select the appropriate shell and inserts and to secure the inserts within the shell using retainer plates 18 and 19 and mounting screws 14. The assembly so constructed can then be mounted to a bulkhead or other mounting surface by screws or the like (not shown) extended through apertures 20 positioned around the periphery of the shell.

The inserts 11*a*–*c* are mounted, within the outer shell 12 in a removable manner with mounting screws 14 such that one or more inserts can easily be removed or replaced when desired without replacing the assembly as a whole and without interfering with other inserts in the assembly.

Connector assembly 10 comprises a receptacle connector assembly, and is known to those skilled in the art, is adapted to be mated with a complementary plug connector assembly (not shown) to complete electrical circuits through the connector. Keying means 15 may be provided on shell 12 to assist in aligning the connector assemblies.

In the embodiment of FIG. 1, shell 12 is configured to define three insert-receiving apertures 13 for receiving and supporting three connector inserts 11*a*–11*c* . Other shell configurations may be provided to support one or any desired plurality of inserts, and it is not intended to limit the invention to any particular shell configuration. Similarly, in the embodiment illustrated in FIG. 1, insert configurations are shown which differ in the number, type and placement of their contacts. These are intended to be exemplary only, and it is also not intended to restrict the invention to any particular insert configuration.

There are many applications in which it would be desirable for one or more of the connector inserts in connector assembly 10 to have a filtering capability, for example, to suppress EMI or RFI interference or other unwanted signals which may exist in circuits connected by the inserts. To retain the convenience and flexibility of the modular construction of assembly 10, however, it is desirable that any filtered insert be fully interchangeable with its unfiltered counterpart. For example, a filtered insert should retain the same dimensions and the same contact placement as its corresponding unfiltered insert so that either insert can be mounted within the same insert-receiving aperture 13 of the same shell 12, and can be connected to the same mating connector. In addition, it is desirable that the filtered insert be easily mounted to and removed from the shell 12 in a manner similar to the unfiltered inserts to permit replacement of the insert when desired.

Connector inserts 11*a* and 11*b* in FIG. 1 comprise filtered connectors inserts possessing the above characteristics, and one insert, i.e., insert 11*a*, is illustrated in greater detail in FIGS. 2–7.

Figure 2:
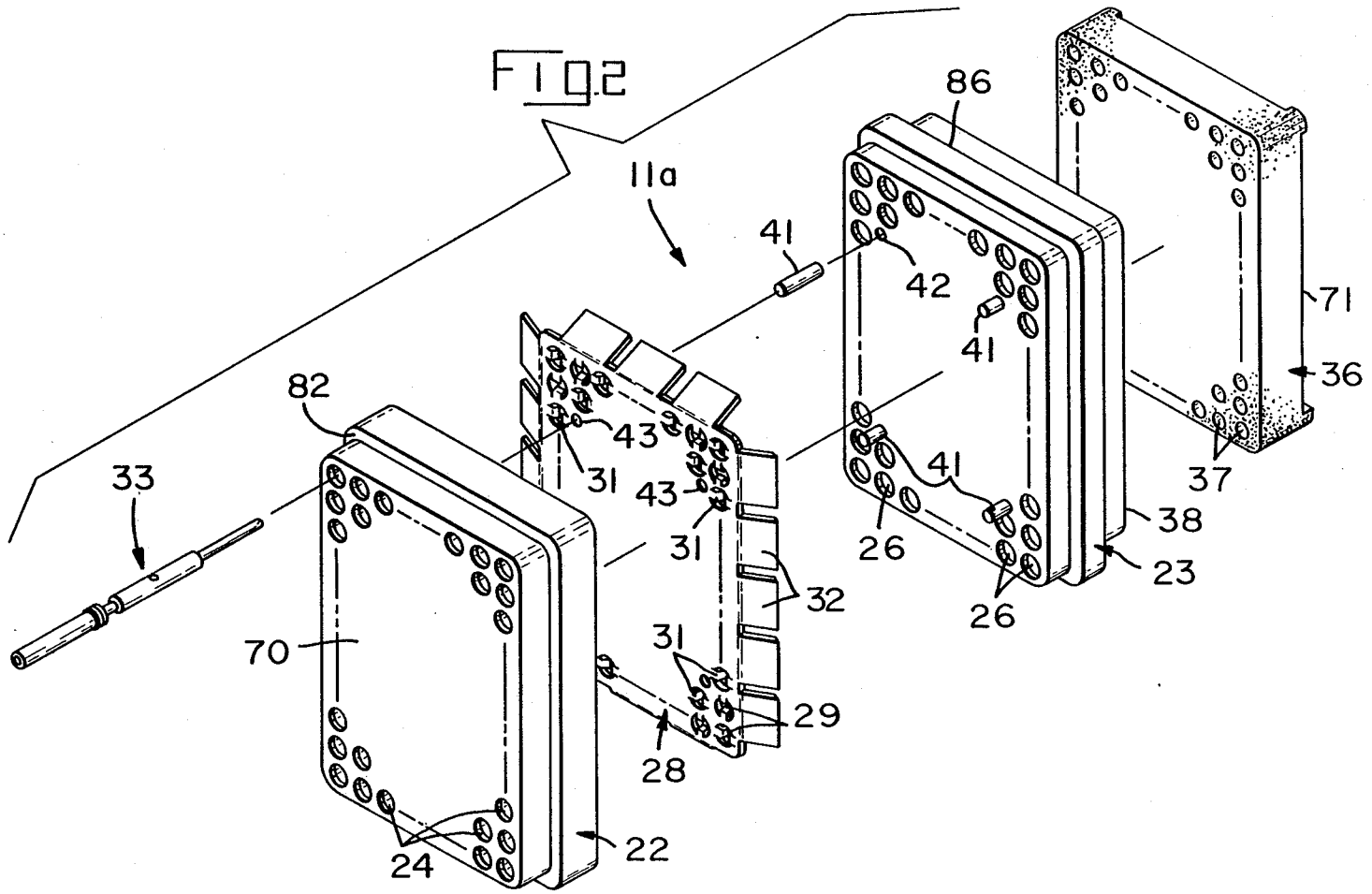
FIG. 2 is an exploded perspective view of the filtered connector insert of FIG. 1.

FIG. 2 is an exploded view of filtered connector insert 11*a*. Insert 11*a* comprises an assembly which includes a front housing plate 22 and rear housing plate 23, both of which are preferably formed of a relatively rigid dielectric material such as a thermosetting epoxy. One suitable material for plates 22 and 23, for example, is marketed by Plaskon, Inc. under the trademark EPIALL.

Figure 5:
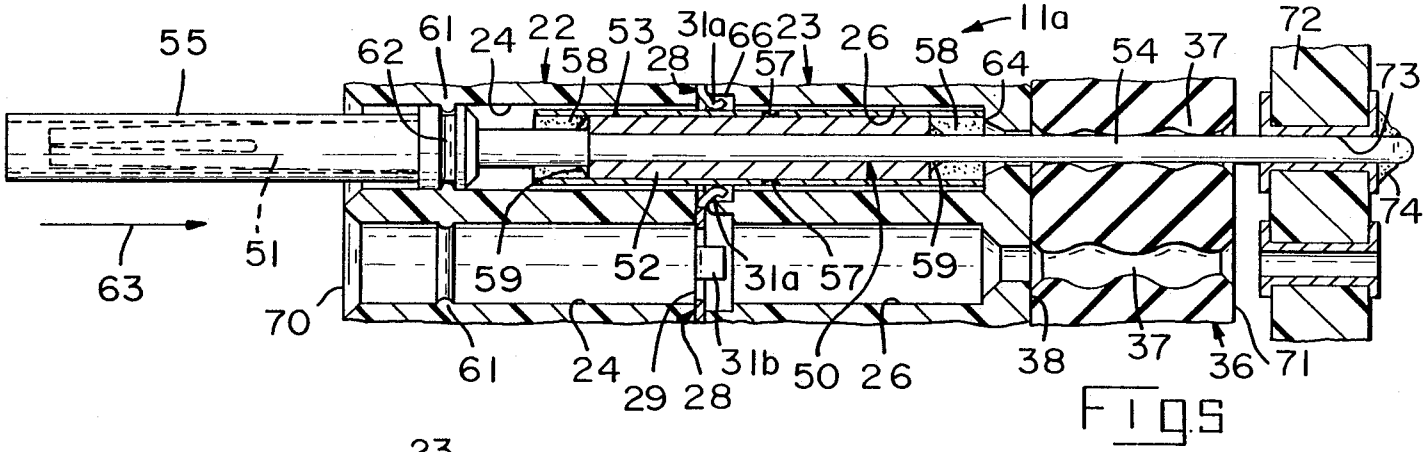
FIG. 5 is a cross-sectional view of the insert of FIG. 2 connected to a printed circuit board.

A plurality of apertures 24 extends through front housing plate 22, and a plurality of apertures 26 extends through rear housing plate 23. Apertures 24 and 26 are arranged in a generally rectangular pattern and are positioned to be in alignment with one another when plates 22 and 23 are assembled together as shown in FIG. 5. As will be described more fully hereinafter, aligned apertures 24 and 26 in front and rear housing plates 22 and 23 are adapted to receive and support a plurality of filtered contact assemblies 33.

In the embodiment illustrated in FIG. 2, connector insert 11*a* comprises a 150-contact insert. Accordingly, plates 22 and 23, as well as other contact-receiving components of the insert, have 150 apertures extending therethrough which will be in alignment with one another when the insert is assembled.

Insert 11*a* further includes a rectangular ground plate 28 which is adapted to be supported between front and rear housing plates 22 and 23. Ground plate 28 is constructed of a resilient, electrically conductive metal such as nickel-plated beryllium copper, and functions as a portion of a grounding plane to dissipate interference filtered by the filters in filtered contact assemblies 33. Ground plate 28 has a plurality of apertures 29 which will be aligned with apertures 24 and 26 in front and rear housing plates 22 and 23 upon assembly of the insert. As will be explained more fully hereinafter, a pair of spring fingers 31 which are integral with plate 28 extend into each of the apertures 29. Spring fingers 31 function as first electrical coupling means to releasably electrically couple ground plate 28 to the filtered contact inserts 33 extending through the apertures. In addition, ground plate 28 is provided with a plurality of integral spring fingers 32 around the periphery thereof which engage the conductive shell 12 of the connector assembly when the insert is mounted within one of the apertures 13. Spring fingers 32 function as second electrical coupling means to releasably electrically couple ground plate 28 to shell 12.

Insert 11*a* also includes a rear sealing member 36 which is attached to the rear face 38 of rear housing plate 23. Sealing member 36 comprises a relatively soft, flexible, nonconductive material such as a fluorosilcone rubber, and is provided with a plurality of apertures 37 which will be aligned with apertures 24, 26 and 29 in front and rear housing plates 22 and 23 and ground plate 28 upon assembly of the insert as shown in FIG. 5. Sealing member 36 functions to prevent the entry of dust and other contaminants into the insert assembly during use of the connector.

To assemble insert 11*a*, sealing member 36 is bonded to the rear face 38 of rear housing plate 23 by a silicone adhesive or other suitable bonding material. The front and rear housing plates 22 and 23 and the ground plate 28 sandwiched therebetween are then pinned together by four retention pins 41 which extend from apertures 42 in rear housing plate 23, through apertures 43 in ground plate 28, and into apertures, not shown, in front housing plate 22. Retention pins 41 reliably hold the insert components together during use, yet permit the front and rear housing plates to be separated from one another, when necessary, to remove or replace the ground plate 28 or for other reasons.

Figure 3:
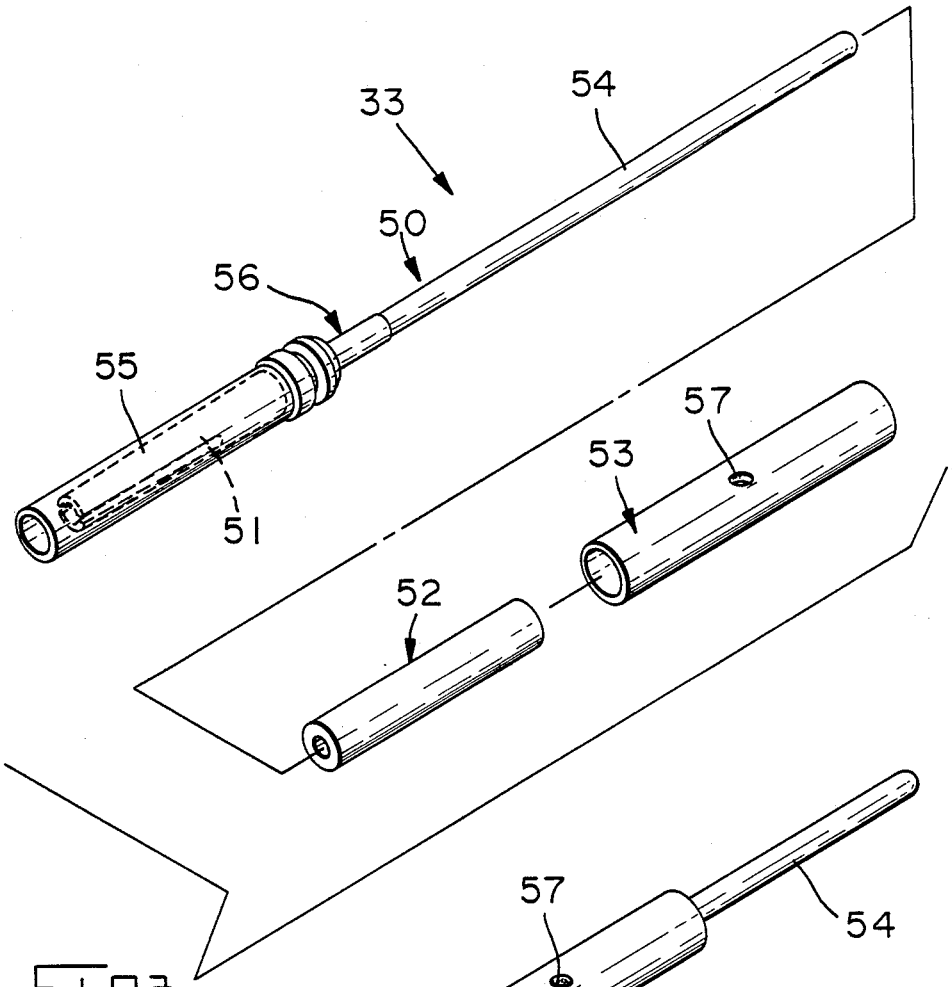
FIG. 3 is an exploded perspective view of the filtered contact assembly of FIG. 2.
Figure 4:
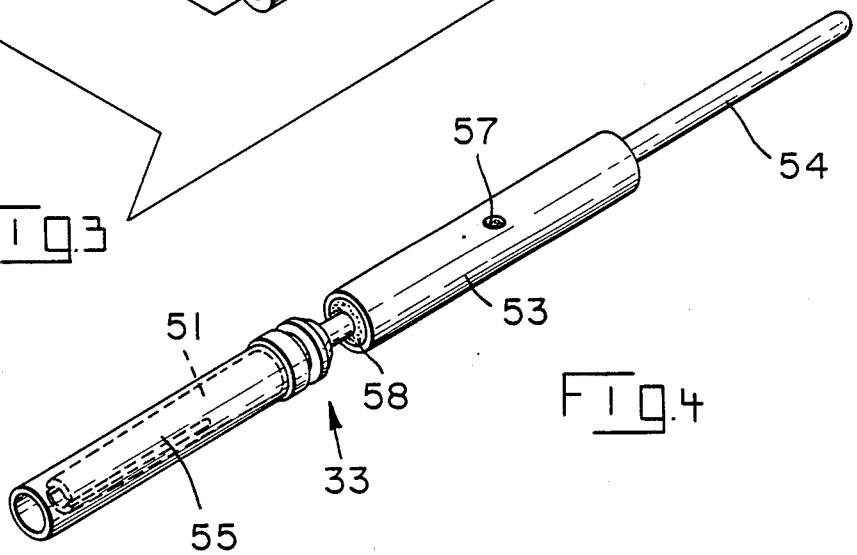
FIG. 4 illustrates the filtered contact assembly of FIG. 3 in assembled form.

FIGS. 3 and 4 illustrate filtered contact assembly 33 in exploded and assembled form, respectively, Filtered contact assembly 33 includes a contact member 50, a filter 52, and a tubular-shaped eyelet 53. Contact member 50 includes a socket and elongated pin portions 51, 54, respectively, and a socket hood portion 55, which is secured to contact member 50 by crimping or the like as is shown at 56. Hood portions 55 protect delicate socket portions 51 from damage during the manufacture and use of the connector.

Filter 52 comprises a tubular filter sleeve and can be of various types as is known in the art depending on the particular application in which the connector is to be used, and need not be described in detail herein. Filter 52 can, for example, comprise a tubular capacitor filter or a distributed element filter such as disclosed in U.S. Pat. No. Re. 29,258. As will be described in connection with FIG. 11, filter 2 can also comprise a lumped element pi filter formed in tubular shape to be incorporated within tubular-shaped eyelet 53.

Eyelet 53 comprises a tubular-shaped element of electrically conductive material, preferably a copper alloy such as nickel-plated beryllium copper. Eyelet 53 is precision extruded to fit snugly within the aligned apertures of the front and back housing plates 22 and 23 of insert 11*a* as shown in FIG. 5. As best shown in FIG. 5, eyelet 53 is somewhat longer than filter 52 to define a space within eyelet 53 on either end of the filter when the filter is positioned within the eyelet.

To assemble filtered contact assembly 33, hood 55 is attached to contact member 50, the pin contact portion 54 of contact member 50 is inserted through filter 52 and the filter is soldered to the contact member 50 at each end thereof with an electrically conductive solder as shown at 59 in FIG. 5. The soldered contact pin/filter sleeve is then inserted into eyelet 53 with the filter substantially centered therein and the eyelet is soldered to the filter. Specifically, eyelet 53 is provided with a pair of small diametrically opposed apertures 57 through which a conductive solder 60 (see FIG. 6) can be inserted into the eyelet to attach and electrically couple the eyelet and the filter. The spaces within eyelet 53 on either end of the filter 52 are filled with a potting material 58 to encapsulate the filter within the eyelet and prevent entry of dirt and other contamination into the eyelet (see FIG. 5). The completed filtered contact assembly 33 is shown in FIG. 4.

As will be explained hereinafter, eyelet 53 both protects the filter 52 and functions as a first portion of a grounding plane for dissipating interference filtered by filter 52.

Figure 7:
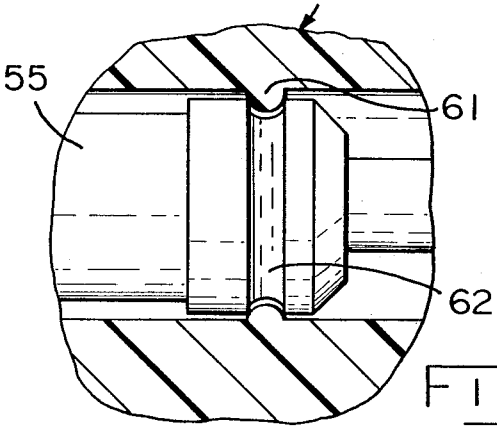
FIGS. 6 and 7 are cross-sectional views illustrating details of the connector insert of FIG. 5.

Filtered contact assembly 33 is designed to be manufactured as a complete, self-contained unit capable of being installed into or removed from insert 11*a* during manufacture or in the field without disassembly of the insert and without interfering in any way with other filtered contact assemblies in the insert. With reference to FIGS. 5 and 7, the wall of each aperture 24 in front housing plate 22 is molded to define an annular, inwardly extending raised rib or flange 61. The outer surface of each socket hood portion 55 of each contact member 50 is configured to define an annular groove 62 adjacent the location where the socket hood portion 55 is crimped to the contact member 50. Rib 61 and groove 62 comprise retention means for releasably retaining the filtered contact assemblies 33 within the insert housing. Specifically, filtered contact assembly 33 is adapted to be inserted into an aperture 24 in front housing plate 22 in the direction indicated by arrow 63 in FIG. 5. Insertion will proceed through the insert housing until groove 62 becomes aligned with rib 61. Upon alignment of the rib and groove, the rib 61 will snap into the groove 62 and releasably lock assembly 33 in the correct position within the insert housing.

The material of front housing plate 22 is sufficiently firm such that the filtered contact assembly 33 will be reliably and firmly retained in position within the insert, yet has sufficient flexibility such that by grasping the exposed portion of hood 55 of contact assembly 33 and pulling in the direction opposite to that of arrow 63, filtered contact assembly 33 as a whole can be removed from the insert without damaging the assembly or the annular rib 61. It should also be noted that shoulder 64 formed at the rear end of rear housing plate 23 functions to limit the rearward movement of the filtered contact assembly 33 during insertion into insert 11*a*.

Figure 6:
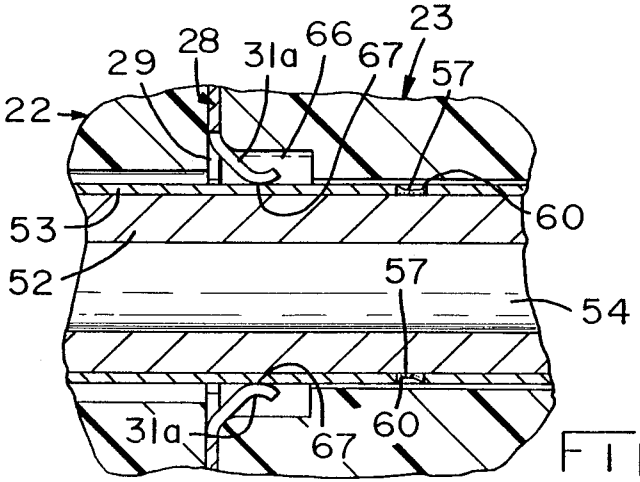

When filtered contact assembly 33 is positioned within insert 11*a*, as shown in FIG. 5, conductive eyelet 53 of the assembly will extend from within aperture 24 of front housing plate 22 through aperture 29 in ground plate 28 and into aperture 26 in rear housing plate 23. As indicated previously, a pair of spring fingers 31 integral with ground plate 28 extend into each aperture 29. Specifically, each aperture 29 has a pair of diametrically opposed spring fingers (identified as 31*a* or 31*b* in FIG. 5) which extend both inwardly and rearwardly from the periphery of each aperture as best shown in FIG. 6. When a filtered contact assembly 33 is inserted through aperture 29, the fingers 31*a* or 31*b* will contact and press against the outer wall of eyelet 53 to electrically couple the eyelet and the ground plate to thereby provide a first releasable electrical coupling means to complete a grounding path from filter 52 to eyelet 53 to ground plate 28. Fingers 31*a* and 31*b* are sized to firmly press against eyelet 53 to provide a reliable electrical couple between eyelet 53 and ground plate 28 without requiring solder or another permanent connection. Accordingly, filtered contact assembly 33 can be inserted into and removed from insert 11*a* whenever desired, and when inserted, the eyelet will automatically be electrically coupled to the ground plate.

As shown in FIGS. 2 and 5, adjacent apertures 29 in ground plate 28 are formed with their spring fingers 31*a* and 31*b* oriented at 180 degrees to one another. By alternating the orientation of the spring fingers in adjacent apertures, the apertures 29 can be positioned very close together in the insert (as is required in a 150-contact insert of the type described herein), while avoiding any interference between the spring fingers of adjacent apertures. As best shown in FIG. 6, fingers 31*a* and 31*b* are preferably rounded at their ends, as shown at 67, to permit filtered contact assembly 33 to be inserted into or removed from the insert without damaging the fingers. As also shown in FIG. 6, a portion 66 of enlarged diameter is formed in the front end of each aperture 26 of rear housing plate 23 to receive the spring fingers As shown in FIG. 5, sealing member 36 is provided with a plurality of apertures 37 which vary in cross-section to define an undulating shape. Apertures 37 reliably seal against the pin portions 54 of contacts 50 for preventing dust and other contaminants from entering into the insert housing; and, at the same time, permit the filtered contact assemblies 33 to be easily inserted into and removed from the insert. To some extent, apertures 37 also help to retain the filtered contact assemblies within the inserts.

The apertures 24 and 26 in front and rear housing plates 22 and 23, respectively, are sized to provide only a very small clearance, for example 0.002 inch, between the inner walls of the apertures and the outer walls of the eyelets 53 received therein. This small clearance helps ensure proper alignment of the filtered contact assemblies within the insert to ensure proper mating to a complementary connector.

As shown in FIG. 5, hooded portions 55 of contacts 50 extend out the front face 70 of insert 11*a* to be mated with the contacts of a complementary connector. Pin contact portions 54 of contacts 50 extend out the rear face 71 of insert 11*a* to be connected to a printed circuit board or the like such as shown at 72. Specifically, the ends of pin contact portions 54 can be extended through apertures 73 in printed circuit board 72 and soldered to conductive paths thereon as illustrated at 74. If it is desired to remove one of the filtered contact assemblies from the insert 11*a*, it is only necessary to first soften the solder 74.

Figure 8:
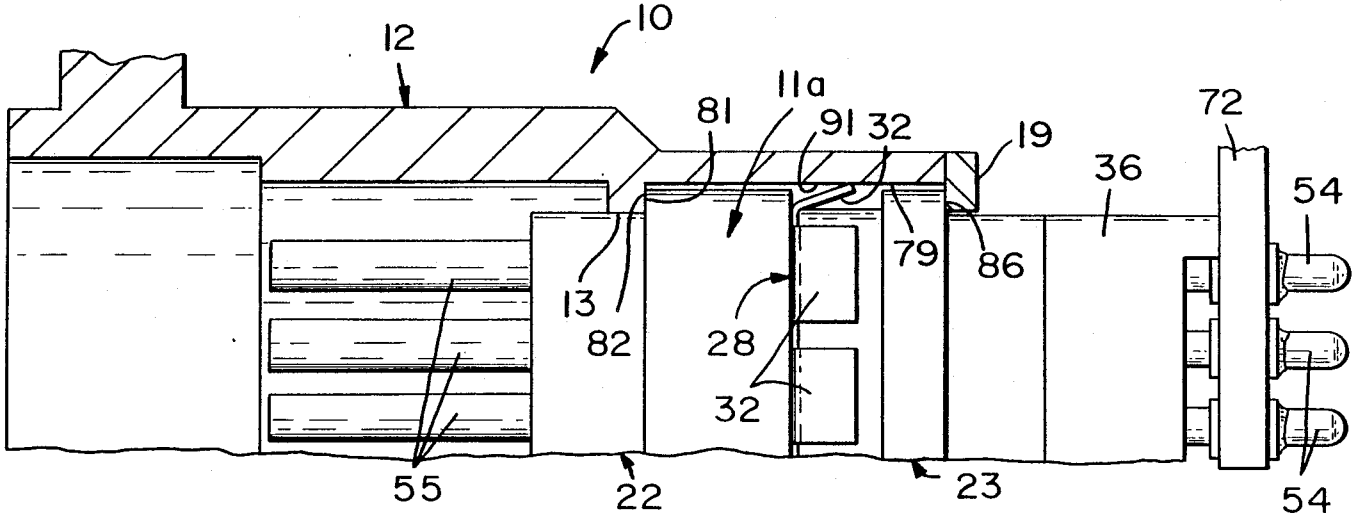
FIG. 8 is a partial cross-sectional view of the connector assembly of FIG. 1 connected to a printed circuit board.

FIG. 8 illustrates insert 11*a* mounted within shell 12 to complete connector assembly 10. As shown, aperture 13 in shell 12 defines a rearwardly facing annular shoulder 81. A forwardly facing shoulder 82 on front housing plate 22 of insert 11*a* (see FIG. 2) is adapted to engage shoulder 81 on the shell when the insert is inserted into aperture 13 to position the insert within the shell. When the insert has been positioned in shell 12, the retaining plate 18 and 19 are positioned against the rear face of the shell and secured to the shell by screws 14 to releasably retain the insert therebetween. The retaining plates will also engage a rearwardly facing annular solder 86 formed on the rear housing plate 23 (see FIG. 2) to firmly restrain the insert 11*a* against movement within the shell.

When insert 11*a* is positioned within shell 12, resilient fingers 32 around the periphery of ground plate 28 will contact and press against the inner wall 91 of shell 12 to establish electrical contact between the ground plate 28 and shell 12. Fingers 32 thus function as second releasable electrical coupling means to complete a grounding path from ground plate 28 to shell 12. Accordingly, energy filtered by filters 52 will be dissipated through the eyelets 53 and the ground plate 28 to the shell 12 and to external ground. Spring fingers 32 provide reliable electrical coupling between ground plate 28 and shell 12 whenever insert 11*a* is positioned within shell 12, and, at the same time, permit insert 11*a* to be placed into and removed from the shell whenever desired. Fingers 32 are preferably positioned around the entire periphery of ground plate 28 to ensure good electrical ground connection for each of the 150 filtered contact assemblies supported within the insert.

Figure 9:
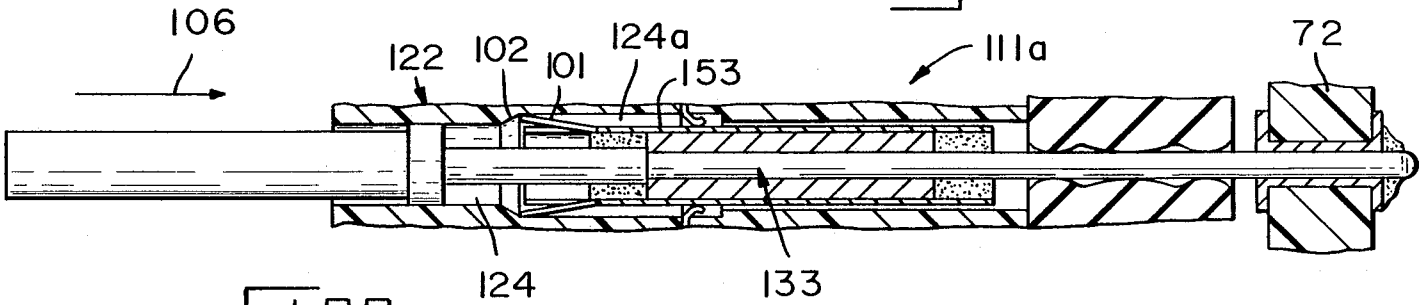
FIGS. 9, 10 and 11 are cross-sectional views of filtered connector inserts illustrating alternative embodiments of the invention.
Figure 10:
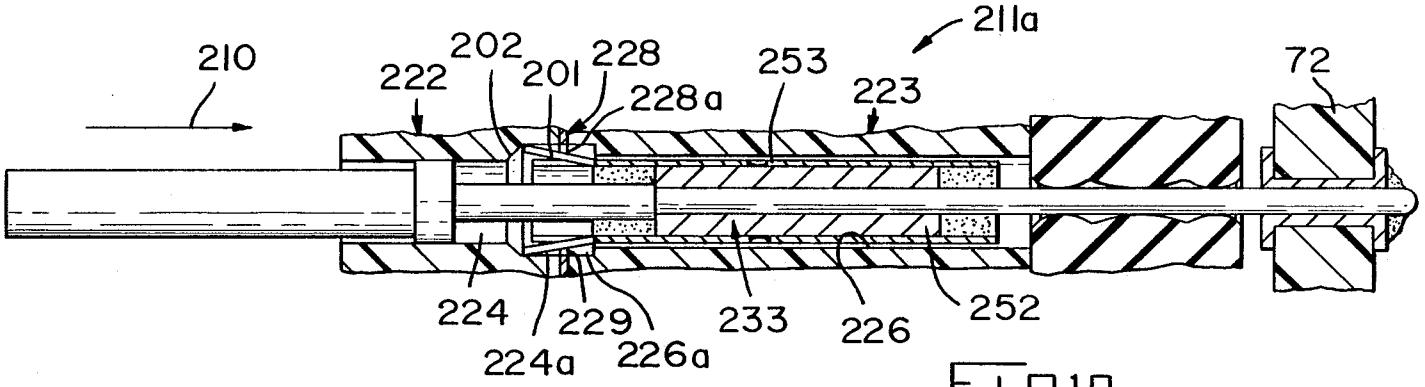
Figure 11:
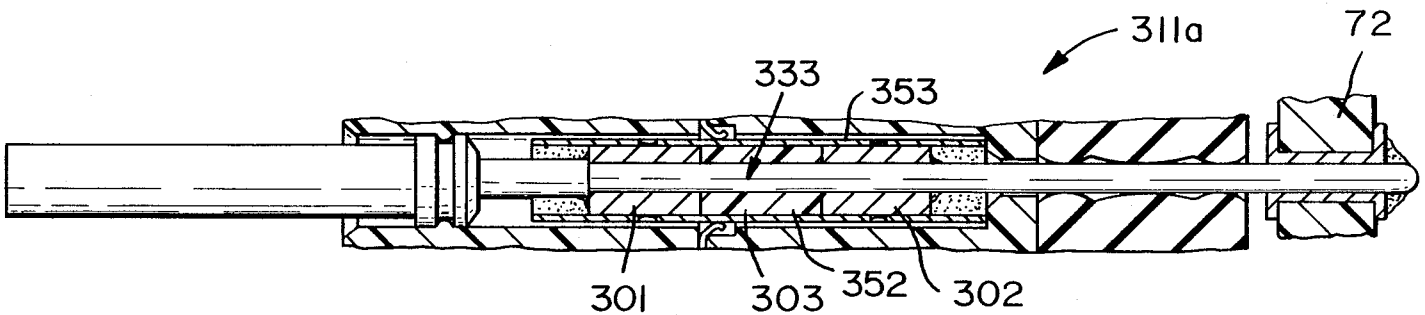

FIGS. 9–11 illustrate alternative embodiments of the invention. In FIG. 9, the filtered contact assembly retention means comprising the annular rib 61 within the apertures 24 of front housing plate 22 and the groove 62 on contact 50 (as previously discussed) has been eliminated and replaced by releasable retention means comprising a plurality of spring fingers 101 on filtered contact assembly 133 cooperating with an internal shoulder 102 on front housing plate 122. Specifically, eyelet 153 is formed with a plurality of integral spring fingers 101 which extend outwardly from one end thereof as shown in FIG. 9. An internal annular shoulder 102 is formed within each aperture 124 in front housing plate 122 by forming a portion 124a of the aperture 124 with an enlarged diameter.

In the embodiment of FIG. 9, when filtered contact assembly 133 is inserted into insert **111*a* in the direction of arrow 106 in FIG. 9, the spring fingers 101 on eyelet 153 will be pressed inwardly against the wall of the aperture 124 in front housing plate 122 until they clear the annular shoulder 102. Upon clearing shoulder 102, fingers 101 will spring outwardly to retain the filtered contact assembly 133 in position within the insert. To remove filtered contact assembly 133 from insert 111*a*, it is only necessary to pull the assembly out of the insert in the direction opposite that of arrow 106. The taper of shoulder 102 will normally permit removal of assembly 133** without damaging the insert or the spring fingers of the filtered contact assembly.

In the embodiment of FIG. 10, eyelet 253 is formed with spring fingers 201 similar to the embodiment of FIG. 9. In FIG. 10, however, the spring fingers 202 both retain the filtered contact assembly 233 within the insert **211*a* and function as first releasable electrical coupling means to electrically couple the eyelet 253 and the ground plate 228. In FIG. 10, ground plate 228 differs from ground plate 28 in the embodiment of FIGS. 2–7 in that the apertures 229 extending therethrough do not have spring fingers extending therein. Additionally, front housing plate 222 is of reduced thickness, and rear housing plate 223 is of increased thickness such that the ground plate 228 sandwiched therebetween is positioned adjacent the spring fingers 201 on eyelet 25. Also, apertures 224 and 226 in front and rear housing plates 222 and 223 are provided with portions 224*a* and 226*a* of increased diameter adjacent the ground plate 228 such that the ground plate will extend slightly into the aperture defined by aperture portions 224*a* and 226*a* as is indicated at 228*a***.

With the construction illustrated in FIG. 10, when filtered contact assembly 233 is inserted into insert **211*a* in the direction indicated by arrow 210, insertion will proceed until spring fingers 201 clear shoulder 202. Upon clearing shoulder 202, the spring fingers will spring outwardly to lock filtered contact assembly 233 in position in the insert 211*a*. When spring fingers 201 spring outwardly, they will also come into contact with the wall of aperture 229 in ground plate 228 to electrically couple the eyelet 253 and the ground plate 228 to complete the grounding path from the eyelet to the ground plate to dissipate interference filtered by filter 252**.

FIG. 11 illustrates a filtered connector **311*a* assembly 333 which differs from assembly 33 in the embodiment of FIGS. 2–7 in that it incorporates a filter 352 which is termed a "lumped-element tubular pi filter". Lumped-element pi filters are known and used in various applications such as in high impedance circuits which require a low-pass filter. The lumped-element pi filter in FIG. 11 has been designed to be incorporated into a tubular-shaped eyelet 353, and includes a pair of capacitor sleeves 301 and 302 separated by a ferrite sleeve 303. The filter is potted within and soldered to conductive eyelet 353** as in the previous embodiments.

While what has been described constitutes presently preferred embodiments of the invention, it should be recognized that the invention can take numerous other forms. For example, other types of filters rather than those described may be incorporated into the filtered contact assemblies. Different types of contacts may be incorporated into the filtered contact assemblies as well. It should also be understood that although the embodiments described herein are designed to permit insertion and removal of the filtered contact assemblies from the front of the inserts, the connector could be designed to permit insertion and removal of the assemblies from the rear, if desired. Because the invention can take numerous forms, it should be understood that the invention should be limited only insofar as is required by the scope of the following claims.

We claim:

1. An electrical connector assembly comprising:

an electrically conductive shell, said shell including at least one insert-receiving aperture;

a filtered connector insert positioned within said insert-receiving aperture, said insert including;

a housing;

at least one filtered contact assembly within said housing, each filtered contact assembly including an electrical contact and filter means electrically coupled to said contact;

means for defining a grounding plane electrically coupling said filter means to said shell for providing a grounding path from said filter means to said shell for dissipating filtered interference, said means for defining said ground plane including first grounding means on each filtered contact assembly, an electrically conductive eyelet surrounding said filter means, and second grounding means on said housing comprising an electrically conductive ground plate in said housing;

respective means associated with each filtered contact for releasably retaining each filtered contact assembly within said housing, said retaining means comprising spring finger means on said filtered contact assembly, and an internal shoulder in said aperture in said housing said spring finger means being integral with and extending from said eyelet and engaging said shoulder upon insertion at said filtered contact assembly into said aperture to oppose the withdrawal of said filtered contact assembly, said spring finger means further comprising first coupling means for releasably electrically coupling said eyelet of said filter means to said second grounding means when said filtered contact assembly is in said housing; and means for releasably mounting said insert within said shell.

2. The connector assembly of claim 1 and further including second coupling means for releasably electrically coupling said second grounding means to said shell.

3. The connector assembly of claim 2 wherein said second coupling means comprises a plurality of spring fingers extending outwardly from said ground plate and adapted to engage said shell when said insert is positioned within said insert-receiving aperture for electrically coupling said ground plate to said shell for dissipating filtered energy to said shell.

4. The connector assembly of claim 1 wherein said housing is substantially enclosed and comprises front and rear dielectric housing means and an electrically conductive ground plate between said front and rear housing means, said front and rear housing means and said ground plate each having a plurality of aligned apertures extending therethrough, said aligned apertures being adapted for receiving a filtered contact assembly therein.

5. The connector assembly of claim 4 wherein each of said aligned apertures has a filtered contact assembly disposed therein.

6. A filtered connector insert for use in a connector assembly containing one or more connector inserts releasably mounted within an outer shell comprising:

housing means, said housing means having a plurality of apertures extending therethrough;

a filtered contact assembly supported within each of said plurality of apertures, each of said filtered contact assemblies including:

an electrical contact;

filter means electrically coupled to said contact; and first grounding means electrically coupled to said filter means comprising an electrically conductive member surrounding said filter means;

respective means associated with each filtered contact for releasably retaining each of said plurality of filtered contact assemblies within its aperture, said retaining means comprising spring finger means on said filtered contact assembly, and an internal shoulder in said aperture in said housing, said spring finger means being integral with and extending from said conductive member of said first grounding means and engaging said shoulder upon insertion of said filtered contact assembly into said aperture to oppose the withdrawal of said filtered contact assembly, said spring finger means further comprising first coupling means for releasably electrically coupling said conductive member of said filter means to second grounding means on said housing when said filtered contact assembly is in said housing for providing a grounding path from said filter means to said second grounding means for dissipating filtered interference; and means for releasably electrically coupling said second grounding means to said shell when said insert is releasably mounted within said shell to provide an external grounding path from said housing to said shell.

7. The connector insert of claim 6 wherein said electrically conductive member of said first grounding means is an electrically conductive eyelet surrounding said filter and electrically coupled thereto, and said second grounding means comprises an electrically conductive ground plate in said housing.

8. The connector insert of claim 7 wherein said means for releasably electrically coupling said ground plate to said shell comprises a plurality of spring fingers extending outwardly from said ground plate and adapted to engage said shell when said insert is positioned within said shell for electrically coupling said ground plate to said shell for dissipating filtered energy to said shell.

* * * * *